United States Patent [19]

Orenstein

[11] 4,262,445

[45] Apr. 21, 1981

[54] CONTROLLABLE RESPONSE SYSTEMS

[76] Inventor: Henry Orenstein, 136 Lakeside Ave., Verona, N.J. 07044

[21] Appl. No.: 11,488

[22] Filed: Feb. 12, 1979

[51] Int. Cl.[3] ..... A63H 13/16

[52] U.S. Cl. ..... 46/145; 46/129; 273/DIG. 25; 124/33

[58] Field of Search ..... 46/145, 129, 146, 148, 46/199, 128; 273/DIG. 25; 124/33

[56] References Cited

U.S. PATENT DOCUMENTS

| | | | |
|---|---|---|---|
| 1,243,380 | 10/1917 | Berger | 46/145 |
| 2,664,077 | 12/1953 | Moore | 273/DIG. 25 |
| 2,680,329 | 6/1954 | Wigal | 46/129 |
| 2,911,758 | 11/1959 | Carson | 46/145 |
| 2,968,121 | 1/1961 | Pearson, Jr. et al. | 46/146 |
| 3,036,834 | 5/1962 | Zalkind | 273/DIG. 25 |
| 3,204,369 | 9/1965 | Green | 273/DIG. 25 |
| 3,425,153 | 2/1969 | Bonanno et al. | 46/119 |
| 3,501,861 | 3/1970 | Goldfarb et al. | 46/129 |

*Primary Examiner*—Gene Mancene
*Assistant Examiner*—John J. Wilson
*Attorney, Agent, or Firm*—George E. Kersey

[57] ABSTRACT

Controllable response toy systems in which the response is delayed by a suitable interval. A toy is set for action by the manipulation of one of its members, such as an arm. The arm thereafter moves spontaneously from the set position, after a suitable interval, and brings about a desired action, such as the throwing of a ball. When the interval resulting from the setting action is variable, the toy gives the appearance of deciding on its own when to take action.

6 Claims, 4 Drawing Figures

CONTROLLABLE RESPONSE SYSTEMS

BACKGROUND OF THE INVENTION

This invention relates to controllable response toys, and, more particularly, to delayed response toys.

In delayed response toys, action on the part of the toy does not occur until after a suitable interval has passed. The interval is usually controlled by a timing mechanism which can be expensive and cumbersome. A typical mechanism is provided by a clock which requires winding or an auxiliary source of power.

In addition, a clock mechanism operates with relative precision, providing a similar delay interval for each activation. A toy which incorporates such a mechanism has a predictable behavior which eventually causes the player to lose interest.

Accordingly, it is an object of the invention to facilitate the delayed response of toys.

Another object is to simplify the mechanism by which the delayed response is produced. A related object is to eliminate the need for clock mechanism to produce the desired response.

Still another object of the invention is to achieve a comparatively unpredictable delay period for each activation and thus help retain user interest in the toy.

SUMMARY OF THE INVENTION

In accomplishing the foregoing and related objects, the invention provides a delayed response toy in which a moveable, spring-loaded portion is held, upon being moved from one prescribed position to another, for a suitable delay interval without the need for a clock mechanism. The delay interval advantageously varies according to the extent and nature of movement of the spring-loaded portion.

In accordance with one aspect of the invention the moveable spring-loaded portion is an arm of a toy figure which can hold an item such as a ball. When the arm is moved from its initial position, it is temporarily retained in a displaced position. After the end of a delay interval the retentive force is overcome and the arm is forced by its spring-loading to its original position. This brings about the release of the ball held by the arm.

In accordance with another aspect of the invention the retentive force is provided by frictional engagement with a plate member. The delay interval can be controlled by varying the coefficient of the friction associated with the engagement.

In accordance with still another aspect of the invention, the plate is engaged by an elastomeric suction cup, and the delay interval is controlled by varying the suction. This can result from the amount of force applied by the user. Or the suction cup can be modified, for example, by having a venting aperture.

DESCRIPTION OF THE DRAWINGS

Other aspects of the invention will become apparent after considering several illustrative embodiments taken in conjunction with the drawings, in which.

DETAILED DESCRIPTION

Figure 1:
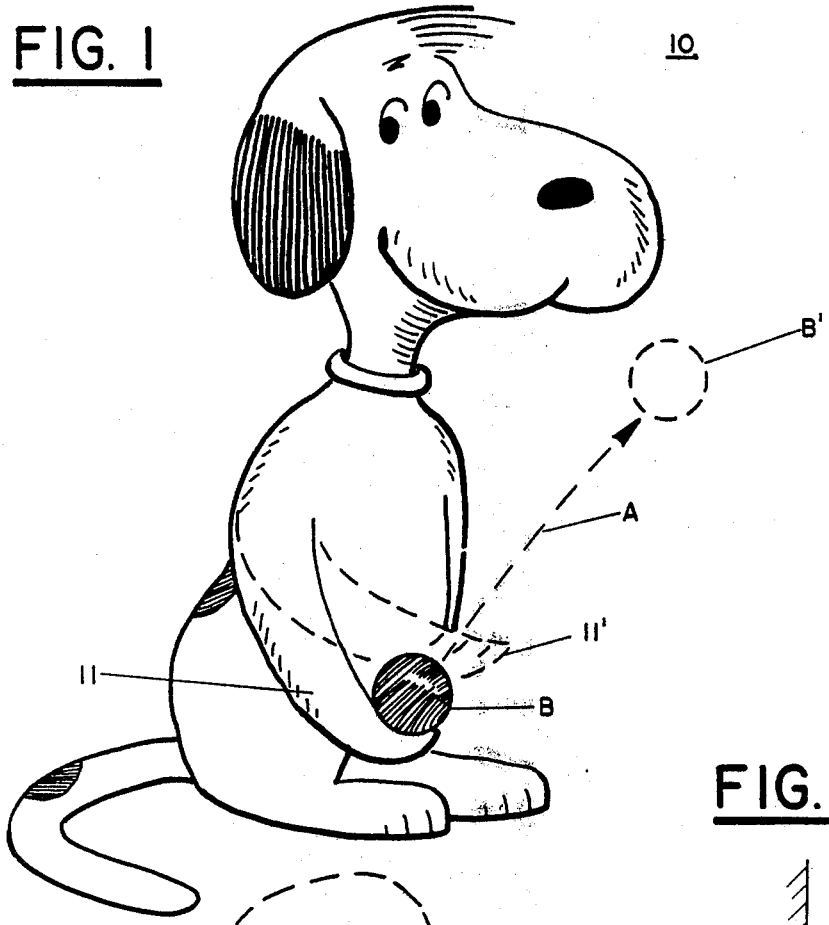
FIG. 1 is a perspective view of a delayed response toy in accordance with the invention.

With reference to the drawings, a delayed response toy dog 10, in a form that has been reproduced by permission, is shown in FIG. 1 with a moveable appendage, e.g. an arm 11, that is set by having been pushed by a user from a phantom position 11'. Thereafter, when the retentive force is overcome, the arm 11 is released and returns to its phantom position 11'. As a result, the ball B held in the paw is released and tossed along a trajectory A to the illustrative phantom position B'.

Where the interval retentive force is variable, for example controlled by the extent to which the arm 11 is pushed from its phantom position 11', the toy 10 has an element of unpredictability which retains player interest.

Figure 2:
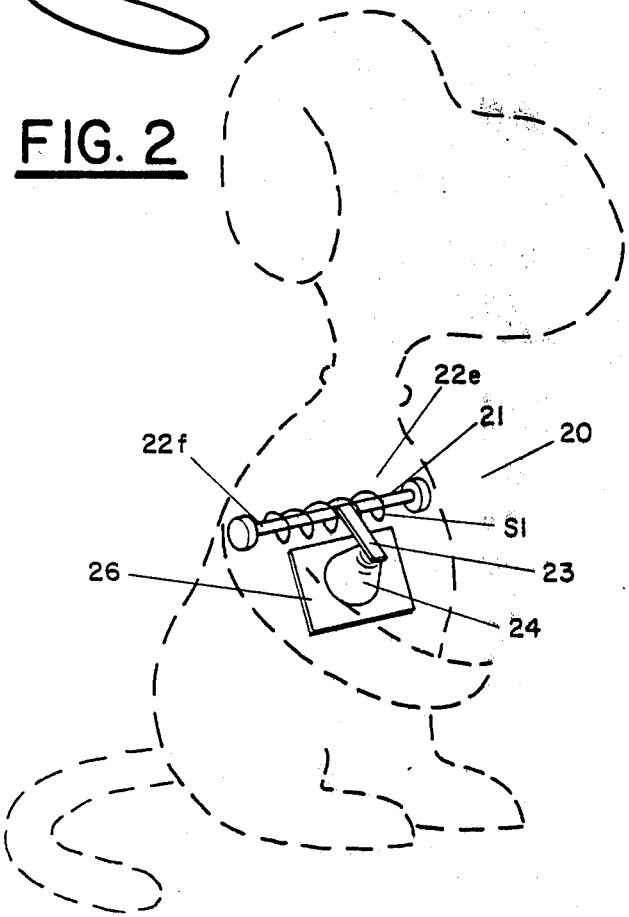
FIG. 2 is a perspective view of a delay control mechanism within the toy of FIG. 1.

An illustrative internal retentive mechanism 20 for accomplishing the invention is shown in perspective in FIG. 2 within the toy dog 10. The illustrative mechanism includes a rotatable shaft 21 that is fixed to the arm 11, a suction cup 24 that is fixed to the shaft and a moveable engagement plate 26 for the cup 24. Encircling the shaft 21 is a spring S1 which has one end **22*f* fixed in the shaft 21 and the other end 22*e* fixed within the toy 10. Affixed to the shaft 21 and extending from it is a cantilever 23 to which is attached the suction cup 24. Consequently when the arm 11 is moved from its phantom position 11', the shaft 21 is rotated, winding the spring S1 and bringing the suction cup 26 into engagement with the plate 26**.

When the retentive force of the suction is dissipated, the spring S1 recoils and returns the arm 11 to its original phantom position 11'.

The delay duration depends upon the coefficient of friction between the cup 24 and the plate 26, which in turn depends upon the extent of the force applied by the user in bringing about the engagement between the cup 24 and the plate 26.

Figure 3A:
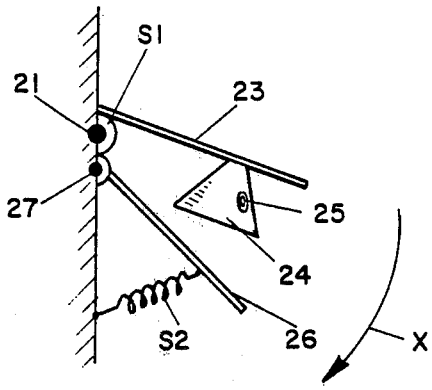
FIG. 3A is a side view of the control mechanism of FIG. 2 in the course of being set.
Figure 3B:
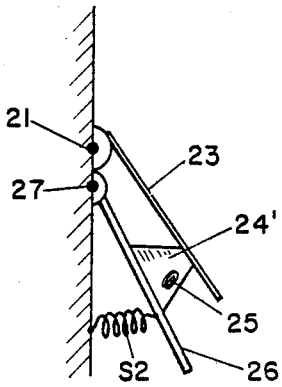
FIG. 3B is a further side view of FIG. 2 showing the control mechanism after it has been set.

An alternative operation of the control mechanism 20 of FIG. 2 is illustrated in FIG. 3A. In FIG. 3A the plate 26 is pivotally hinged at pivot point 27 and is loaded by a spring 52. This promotes the desired engagement of the cup 24 with the plate 26. When the arm 11 of the toy dog 10 is rotated in its socket, this causes rotation of the cantilever 23 fixed to the shaft 21 in the direction indicated by the arrow X. When the suction cup 24 makes initial contact with the plate 26, the latter yields slightly, causing partial compression of the spring S2. The yielding action of the plate 26 with respect to the suction cup 24 assures a suitable suction engagement. The result is as shown in FIG. 3B at the end of the setting action of the user. Thereafter the spring S2 expands to its original position with suction cup 24' held to the plate 26 only for a limited delay interval.

The length of the interval can be controlled by various modifications in the suction cup structure, one of which, illustrated in FIGS. 3A and 3B, is the provision of a small aperture 25. The size of the aperture 25 has an effect on the retentive force, the bigger the opening, the shorter is the duration of the force.

It is apparent that other modifications are possible, including, for example, the provision (not shown) of a lateral rib across the face of the plate 26.

While various aspects of the invention have been set forth by the drawings and specification, it is to be understood that the foregoing detailed description is for illustration only and that various changes in parts, as well as the substitution of equivalent constituents those shown and described may be made without departing from the spirit and scope of the invention as set forth in the appended claims.

What is claimed is:

1. A delayed response toy comprising
a movable appendage for said toy,
a rotatable shaft within said toy fixed to said appendage,
a suction cup fixed to said shaft,
a spring encircling said shaft and having one end thereof fixed to said shaft and the other end thereof fixed within said toy,
a cantilever affixed to said shaft and extending to said suction cup,
a plate within said toy pivotally hinged below said shaft, said plate being spring loaded and positioned to face said suction cup,
whereby rotation of said appendage causes rotation of said cantilever and suction cup attached thereto to make initial contact with said plate which yields and assures suitable suctional engagement with said suction cup during the further rotation of said appendage, after which the suction cup becomes spontaneously disengaged from said plate after a prescribed interval of time.

2. A toy as defined in claim 1 wherein said spring-loaded member is an arm with a releasable object which is released at the end of said limited period of time.

3. A toy as defined in claim 1 wherein said suction cup has an aperture to control the duration of the suction.

4. A toy as defined in claim 1 wherein said suction cup includes a lateral rib therein to control the duration of the suction.

5. A toy as defined in claim 1 wherein said plate is configured to control the duration of the suction.

6. A toy as defined in claim 5 wherein said plate includes a lateral rib across the face thereof to control the duration of the suction.

* * * * *